United States Patent [19]

James, II et al.

[11] 3,965,548

[45] June 29, 1976

[54] CRIMPER STARTUP METHOD AND SYSTEM

[75] Inventors: Edward William James, II, Oxford, Pa.; Warren Eugene Kenney, Waynesboro, Va.

[73] Assignee: E. I. Du Pont de Nemours and Company, Wilmington, Del.

[22] Filed: Jan. 31, 1975

[21] Appl. No.: 546,129

[52] U.S. Cl. ..... 28/1.7; 28/72.14
[51] Int. Cl.[2] ..... D02G 1/12
[58] Field of Search ..... 28/1.6, 1.7, 72.14

[56] References Cited

UNITED STATES PATENTS

| | | | |
|---|---|---|---|
| 3,341,913 | 9/1967 | Jenkins et al. | 28/1.7 X |
| 3,570,083 | 3/1971 | Stanley | 28/1.6 |
| 3,863,311 | 2/1975 | Cartlidge et al. | 28/1.7 |

*Primary Examiner*—Louis K. Rimrodt

[57] ABSTRACT

In a tow processing system that includes a draw machine operating in conjunction with a tow crimper that has a clapper for exerting counterpressure at the outlet end of the crimper, draw machine tachometer-generator signals are converted to proportionate signals which control clapper pressure and crimper steam pressure in a preselected sequence according to draw machine speed to regulate tow crimper conditions during start up of the system.

4 Claims, 2 Drawing Figures

CRIMPER STARTUP METHOD AND SYSTEM

BACKGROUND OF THE INVENTION

This invention relates to a continuous process for drawing, crimping and collecting a tow composed of continuous filaments. More particularly, it relates to control of the crimping step during the start up of the continuous process.

In the commercial production of acrylic and other synthetic crimped fibers, a tow consisting of a multiplicity of spun continuous filaments is usually prepared first. The tow is then drawn, crimped in a stuffer box crimper and collected in a container. In the case of acrylic tow, the drawing is a wash-draw process as described by Davis and Palmer in U.S. Pat. No. 3,124,631 and the tow is moist when it is crimped and collected. In the operation of the stuffer box crimper, feed rolls force the tow being fed from the draw machine into a crimper chamber having its exit end restricted by an air cylinder loaded clapper plate, after which the crimped tow passes out of the crimper onto a cooling conveyor and is then piddled into a container. At start up, the tow is nonuniform and the piddler is set to divert it to waste collection. When the process is running smoothly, the piddler setting is changed to deliver the tow to the product collection container.

At each start up, the operator must continually adjust the clapper plate pressure of the crimper as the draw machine speed increases to operating speed, while also adjusting the supply of steam to the crimper. If the clapper plate pressure or steam pressure are adjusted incorrectly, the tow jams in the crimper and the draw machine must be shut down and restarted. In actual practice, the operator must try to get the "feel" of the crimper adjustments during start up, much as the operator of an automobile with manual transmission does; at times he fails and the crimper jams. To avoid undue waste as a consequence of operator error which may result in several false starts before the process is running smoothly, it is highly desirable to remove the human element from this portion of the start up of the process.

SUMMARY OF THE INVENTION

It has been discovered that changing crimper steam and clapper pressures through a range of adjustments in direct proportion to draw machine speed when resuming operations after each draw machine stop greatly reduces the incidence of tow jams in the crimper. To do this, an apparatus is provided which converts voltage signals from the draw machine tachometer-generator to pneumatic signals which are used to regulate clapper pressure and steam pressure to the crimper according to the speed of the draw machine.

DETAILED DESCRIPTION OF THE PREFERRED EMBODIMENT

Figure 1:
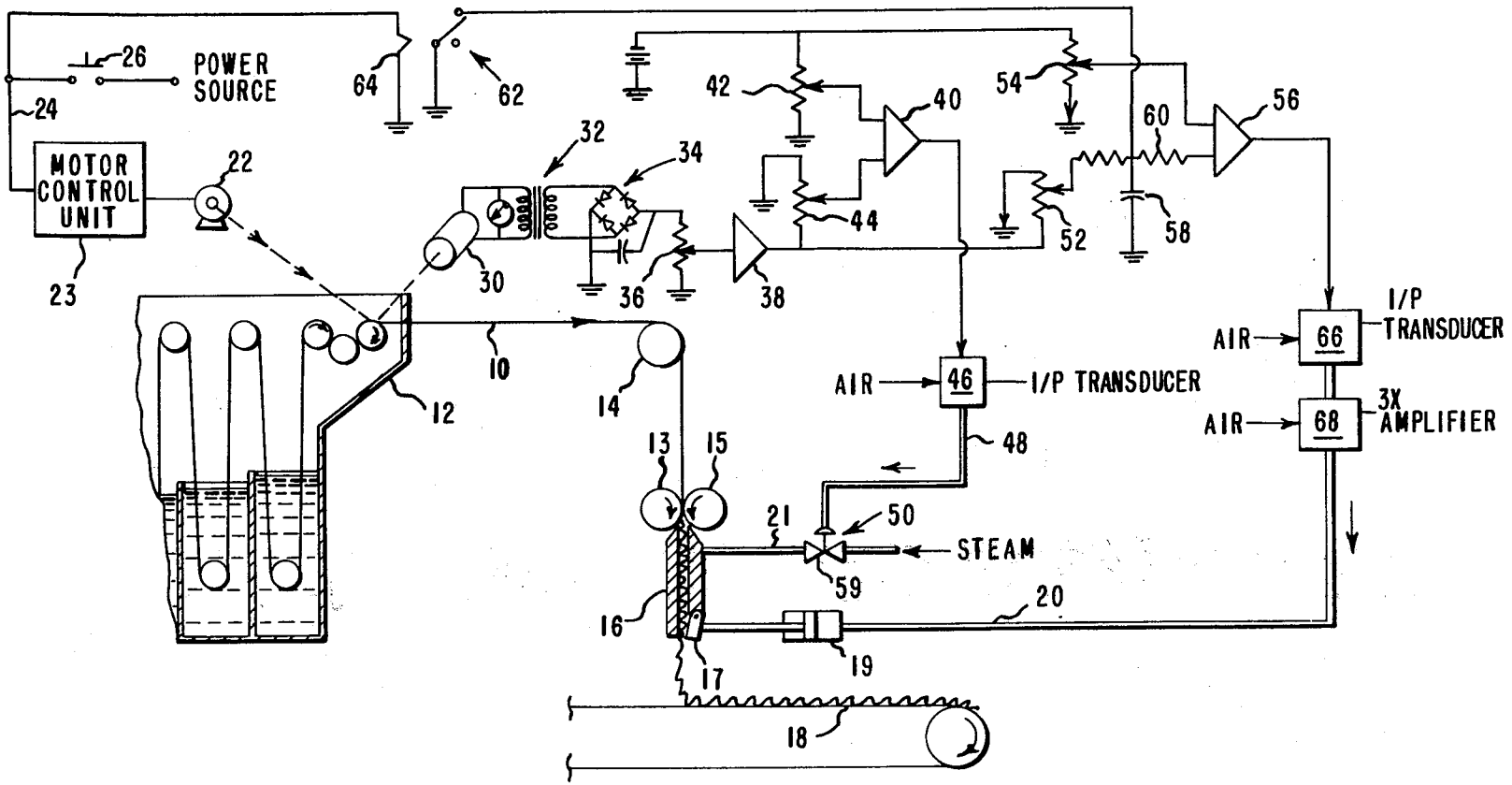
FIG. 1 is a schematic illustration of a continuous process for drawing and crimping tow with circuitry and apparatus to regulate crimper steam and clapper pressures according to draw machine speed.

For an explanation of the process, attention is invited to FIG. 1 wherein a yarn bundle or tow 10 of continuous synthetic filaments is fed from a wash-draw machine 12 of the type disclosed in U.S. Pat. No. 3,124,631 over roll 14 and into a stuffer box crimper chamber 16 by means of driven feed rollers 13, 15. Tow 10 is directed into the chamber 16 against the combined force of a mass of crimped tow held compacted in the chamber and the force applied by counterpressure means which may be a pivoted clapper 17 in the side wall of the chamber 16 acted on by an air cylinder 19. The counterpressure may be adjusted by regulation of the air supply to the cylinder from pipe line 20. Tow builds up in the crimper chamber 16 until the pressure in that chamber is sufficient to move clapper 17 when crimped tow is forced from the chamber onto collecting belt 18 for transportation to the next step in the process which is usually a collecting step as described by Mendes in U.S. Pat. No. 3,378,898. Steam is supplied to stuffer chamber 16 via pipe 21.

An electric motor 22 drives the rolls of wash-draw machine 12 and power is supplied to the motor through a motor control unit 23 connected to a power source through line 24 and switch 26. A tachometer-generator 30 coupled to the draw machine 12 provides an a.c. output signal voltage proportional to the draw machine speed. The output voltage of tachometer-generator 30 is fed through transformer 32 and then to a diode bridge 34 where it is converted to d.c. signals developed across potentiometer 36. A fraction of these d.c. signals are tapped off potentiometer 36 and fed to buffer amplifier 38. The output voltage from amplifier 38 is developed across potentiometers 44 and 52 which provide one of the inputs for operational amplifiers 40 and 56, respectively. The other input for amplifiers 40 and 56 is developed across potentiometers 42 and 54 from an 18 volt negative d.c. source connected to the potentiometers. In this fashion, circuitry is provided to add together the first signals as developed from the output of tachometer-generator 30 with a second signal of constant magnitude in amplifiers 40 and 56 which provide third signals as their outputs that are proportionate to draw machine speed. These third signals are fed from amplifiers 40 and 56 to current to pressure (I/P) transducers 46 (Moore Products I/P Transducer 0–4MA input, 3–15 psi. output) and 66 (Moore Products I/P Transducer 0–4MA input 1–13 psi. output), resectively. A 20 psi. supply of air is connected to both transducers 46 and 66. An amplifier 68 (Moore Products 3X Booster Amplifier), which is provided with a source of 80 psi. air is connected to the output of transducer 66 to provide an output of 3 to 39 psi.

A time lag circuit comprising capacitor 58 and resistor 60 is connected to the input of amplifier 56. One end of the capacitor is connected to ground while the other end is connected to switch 62 which in turn is connected to ground and operated by relay 64 in a manner to be described later.

During the time the machine is shut down, the pressure of steam supplied to the crimper chamber 16 through pipe 21 is maintained at a constant level to maintain the desired operating temperature in the chamber 16 of the crimper. This constant steam pressure is maintained by keeping control valve 50 partially open by a preselected output from transducer 46 in response to a signal from amplifier 40 which has an input when the draw machine is stopped of a constant d.c. voltage tapped off from potentiometer 42. When the draw machine is started, the amplifier 40 receives an additional input signal developed across potentiometer 44 which is proportional to the voltage output of tach-generator 30 and therefore to the draw machine speed. These first signals across potentiometer 44 are combined with a second signal of constant magnitude developed across potentiometer 42 in amplifier 40 to produce a third signal at the output of amplifier 40 which increases with increasing speed of the draw machine 12 and in turn increases the output air pressure of transducer 46 causing control valve 50 to open more. This increases the pressure of steam to chamber 16 at a uniform rate as the speed of the draw machine 12 increases.

In a similar fashion, the pressure applied to the clapper 17 by cylinder 19 is regulated by air pressure supplied to cylinder through pipe 20. This pressure is maintained at a low level during draw machine shut down by a preselected setting of transducer 66 governed by the amount of voltage tapped off from potentiometer 54 and fed through amplifier 56 to the transducer. When the draw machine is started by actuation of switch 26, the amplifier 56 receives an additional input signal developed across potentiometer 52 which is proportional to the voltage output of tach-generator 30 and also to draw machine speed. These first signals across potentiometer 52 are combined with a second signal of constant magnitude (developed across potentiometer 54) in amplifier 56 to produce third signals at the output of amplifier 56 that increase with increasing speed of the draw machine 12. These increasing signals are lagged upon actuation of the start switch 26 (so that the clapper pressure reaches steady state about 2 seconds after the draw machine speed reaches steady state) while the capacitor of resistor capacitor circuit 58, 60 connected to the input of amplifier 56 is charged. Each time the draw machine is stopped, by opening switch 26, relay 64 operates to connect switch 62 to the capacitor 58 thus discharging it through ground. Conversely, when switch 26 is closed and the draw machine is running, relay 64 operates to move switch 62 to the open position. The increasing output from amplifier 56 increases the output air pressure of transducer 66 which is increased by a factor of 3 in passing through amplifier 68 before being fed to cylinder 19 to increase the pressure on flap 17 in accordance with draw machine speed.

Figure 2:
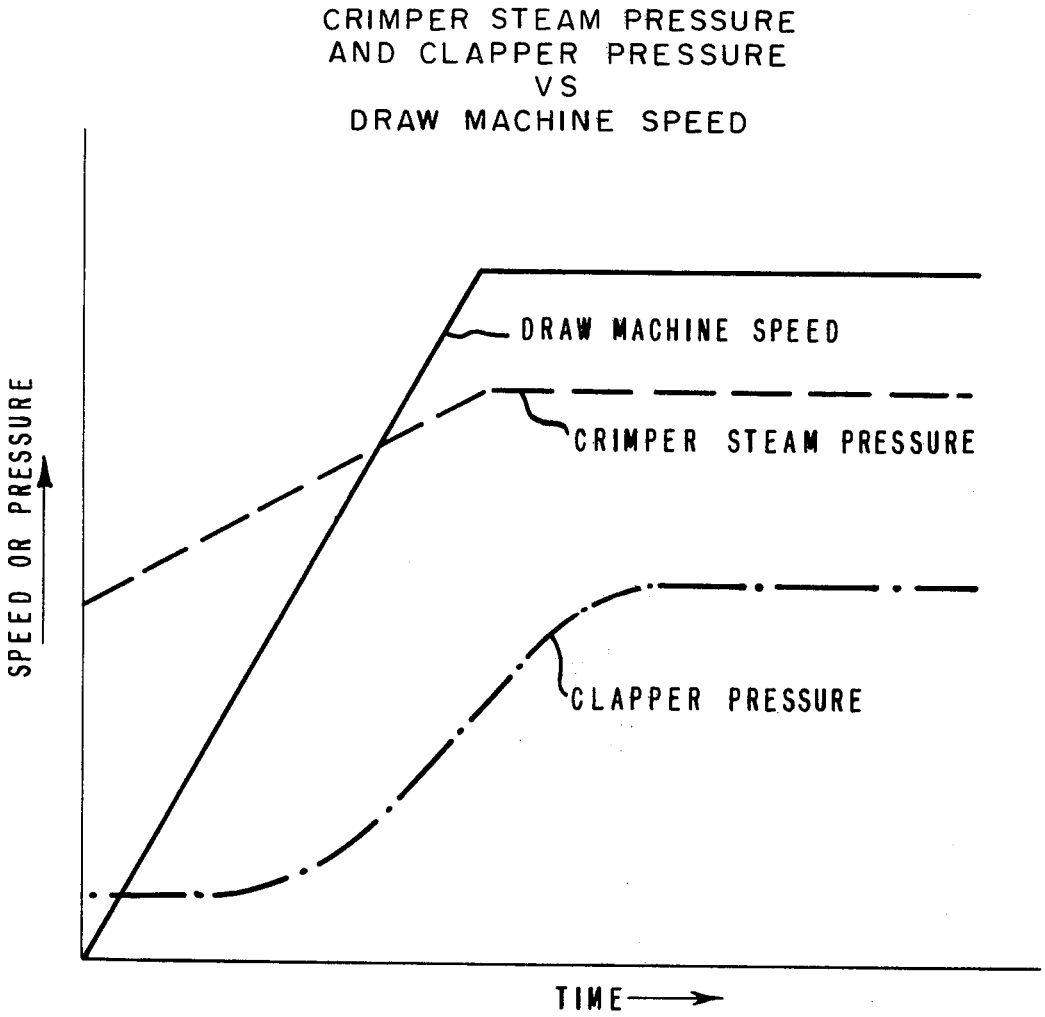
FIG. 2 represents response curves of crimper steam pressure and crimper clapper pressure versus draw machine speed when operating according to the invention.

The above-described relationships of crimper steam pressure and clapper pressure versus draw machine speed at start up are shown in FIG. 2. The draw machine takes approximately 20 seconds to go from a stopped position to normal running speed. The clapper pressure, lagging the draw machine speed by about 2 seconds, increases to an operating level in direct relation to speed and the crimper steam pressure increases to its normal operating level also in accordance with draw machine speed. It is essential that the increase in the pressure applied by the clapper plate lags, or occurs more slowly, than the increase in the draw machine speed. If the clapper plate pressure is not lagged with respect to the draw machine speed, it is quite likely that the tow will jam in the crimper, after which the machine must be shut down. All of the tow processed through the crimper during such an aborted start up must be diverted to waste. By the use of this invention, it has been found in commercial practice that a reduction of more than 50% of the tow wasted in start ups can be achieved.

It will be apparent to one skilled in the art that variations of this invention may be made without departing from the spirit and scope thereof.

What is claimed is:

1. In a method for producing crimped tow by continuously feeding tow from a draw machine against an adjustable counterpressure means in a stuffer chamber and discharging the tow, the improvement comprising: automatically adjusting the counterpressure means according to the speed of the draw machine after delaying said adjusting step at startup of said draw machine.

2. In a method for producing crimped tow by continuously feeding tow from a draw machine against an adjustable counterpressure means in a stuffer chamber of a crimper then discharging the tow and including the step of heating the stuffer chamber by supplying an adjustable amount of steam thereto, the improvement comprising: automatically adjusting the amount of steam supplied to the stuffer chamber according to the speed of the draw machine and automatically adjusting the counterpressure means according to the speed of the draw machine after delaying adjusting the counterpressure means momentarily following startup of said draw machine.

3. The method of claim 2, adjusting both the amount of steam supplied to the stuffer chamber and the counterpressure means in direct proportion to changes in speed of the draw machine.

4. In a system for drawing and crimping tow including a driven draw machine from which tow is continuously passed to a stuffer box crimper having a feed means, along with an adjustable steam supply and an adjustable counterpressure means, an apparatus for adjusting both the crimper steam supply and the adjustable counterpressure means according to draw machine speed as the machine speed increases during startup comprising: a tachometer coupled to the draw machine for detecting draw machine speed and generating first signals proportional thereto; means coupled to said tachometer for combining said first signals with second signals of constant magnitude to produce third signals; control means responsive to said third signals for changing the adjustable steam supply; control means responsive to said third signals for changing the adjustable counterpressure means; and a time lag device connected to said means for producing third signals for momentarily delaying the third signals for changing the adjustable counterpressure means.

* * * * *